US006676151B2

(12) United States Patent
Mangold et al.

(10) Patent No.: US 6,676,151 B2
(45) Date of Patent: Jan. 13, 2004

(54) SKI OR SNOWBOARD BINDING WITH COUNTERFLEX DAMPING OF THE SKI

(75) Inventors: Michael Mangold, Farchant (DE); Werner Messerschmidt, Farchant (DE); Johann Schuhbauer, Weilheim (DE); Ludwig Wagner, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 55 days.

(21) Appl. No.: 10/023,541

(22) Filed: Dec. 17, 2001

(65) Prior Publication Data

US 2002/0093174 A1 Jul. 18, 2002

(30) Foreign Application Priority Data

Dec. 15, 2000 (DE) ..... 100 62 727
Jul. 31, 2001 (DE) ..... 101 37 378

(51) Int. Cl.[7] ..... A63C 9/08

(52) U.S. Cl. ..... 280/602; 280/616; 280/607; 280/618

(58) Field of Search ..... 280/602, 607, 280/609, 610, 616, 617, 618, 11.14

(56) References Cited

U.S. PATENT DOCUMENTS

| | | | | |
|---|---|---|---|---|
| 3,260,532 A | | 7/1966 | Heuvel | |
| 3,937,481 A | | 2/1976 | Koleda | |
| 4,974,867 A | | 12/1990 | Rullier et al. | |
| 5,251,923 A | | 10/1993 | Stepanek et al. | |
| 5,320,377 A | * | 6/1994 | Ruffinengo | 280/602 |
| 5,326,126 A | * | 7/1994 | Ruffinengo | 280/602 |
| 5,395,132 A | * | 3/1995 | Abondance et al. | 280/607 |
| 5,421,602 A | * | 6/1995 | Stepanek et al. | 280/602 |
| 5,597,170 A | * | 1/1997 | Le Masson et al. | 280/602 |
| 5,651,560 A | * | 7/1997 | Stepanek et al. | 280/602 |
| 5,681,054 A | * | 10/1997 | Bonvallet | 280/602 |
| 5,704,628 A | * | 1/1998 | Boehm et al. | 280/602 |
| 5,713,593 A | * | 2/1998 | Renaud-Goud et al. | 280/607 |
| 5,775,716 A | * | 7/1998 | Harsanyi et al. | 280/602 |
| 5,779,257 A | * | 7/1998 | Bonvallet et al. | 280/602 |
| 5,806,875 A | * | 9/1998 | Bonvallet | 280/602 |
| 5,924,717 A | * | 7/1999 | Janisch et al. | 280/602 |
| 5,984,344 A | * | 11/1999 | Harsanyi et al. | 280/602 |
| 6,065,895 A | * | 5/2000 | Lehner et al. | 403/105 |
| 2002/0093174 A1 | * | 7/2002 | Mangold et al. | 280/602 |

FOREIGN PATENT DOCUMENTS

| | | |
|---|---|---|
| EP | 0 409 749 B1 | 1/1991 |
| EP | 0 492 658 A1 | 7/1992 |
| WO | WO 83/03360 | 10/1983 |

* cited by examiner

*Primary Examiner*—Brian L. Johnson
*Assistant Examiner*—J. Allen Shriver
(74) *Attorney, Agent, or Firm*—D. Peter Hochberg; Katherine R. Vieyra; Sean Mellino

(57) ABSTRACT

A device, which is preferably designed in the manner of a standing plate for a ski binding or the like, having abutments between which there is a damper unit, preferably hydraulic, which can be uncoupled from an abutment so that it is possible to switch to a state with effective damping and a state without effective damping.

17 Claims, 3 Drawing Sheets

SKI OR SNOWBOARD BINDING WITH COUNTERFLEX DAMPING OF THE SKI

BACKGROUND OF THE INVENTION

1. Field of the Invention

This invention relates to a device for damping the flexing movements of a ski or a snowboard with a damping device which has two damping elements that are displaceable relative to one another in a longitudinal direction against damping resistance and which is arranged on the top side of the ski or snowboard.

2. Description of the Prior Art

Such a device is illustrated in FIGS. 13 and 14 of U.S. Pat. No. 5,251,923. The damping device is designed as a double-acting hydraulic piston-cylinder unit in which the cylinder and housing are displaced relative to one another when there are flexing movements, whereby hydraulic medium flows from one chamber into the other chamber through an adjustable throttle which is arranged hydraulically between two chambers divided by the piston in the cylinder. Different damping resistance levels can be established through appropriate adjustment of the throttle.

SUMMARY OF THE INVENTION

The object of this invention is to provide a device for damping the flexing movements of a ski or snowboard, having two damping members displaceable relative to each other in the longitudinal direction of the ski against a damping resistance. Another object is to also permit an adjustment of the damping in which the flexing characteristics of the ski or the like, which flexing characteristics are determined by the design, remain almost completely unchanged. A further object, in addition, is to permit an adjustment of the damping of flexing movements of the ski or the like.

This object is achieved with the device as described in the preceding paragraph by the fact that an element of the damper unit is secured on a first abutment, which is or can be rigidly mounted on the ski or the like, and the other element of the damping unit is detachably secured on another abutment, which is or can be mounted on the ski or the like, at a distance from the first abutment in the longitudinal direction.

This invention is based on the general idea of arranging the damping device in such a way that it can be turned on and off in that the one damper element can be mechanically coupled to or uncoupled from the respective abutment. This makes it possible to achieve a frictional connection, which has a damping effect, between the two abutments in that the one damping element is brought into its condition of being connected to the abutment. On the other hand, a condition that is practically free of frictional connection is also possible in that the damper unit is mechanically separated from the aforementioned abutment in terms of function.

DESCRIPTION OF THE PREFERRED EMBODIMENT

According to a preferred embodiment of the invention, one element of the damper unit is rigidly connected in the longitudinal direction to a coupling part which works together with a mating coupling part of the other abutment which is adjustable between two end positions, the coupling part in the one end position of the mating coupling part being retained in a form-fitting manner in the longitudinal direction relative to the other abutment and being moveable in the longitudinal direction in the other end position of the mating coupling part.

This guarantees a simple design in which the damper unit can be designed in principle in almost any desired manner, but according to a preferred embodiment, so that effective damping is achieved especially with so-called counter-flexing movements of a ski, in which the ends of the ski or the snowboard swing downward relative to the area of the bindings, while there is little or no damping of flexing movements in which the ends of the skis move upward relative to the area of the bindings.

In an especially expedient design, the mating coupling part is designed as a slide which in one end position securely holds a claw of the coupling part in a form-fitting manner and releases the claw in its other end position.

It is provided here in particular that the mating coupling part is designed as a rotary slide which engages behind the claw with a portion of its peripheral wall in its one end position and retains it in the longitudinal direction, and, in its other end position, the mating coupling part releases the claw in the longitudinal direction with a recess in its peripheral wall.

The rotational mounting of the rotary slide may be accomplished by means of a crank guide, which is arranged outside of the axis of rotation, so that a correspondingly large space is available for the claw within the peripheral wall of the rotary slide.

In addition, the damper is preferably designed so that it dampens only or mainly only so-called counter-flexing movements of the ski, i.e., downward movement of the ends of the ski relative to the central area of the ski.

This invention includes this general idea, regardless of whether or not the damper can be uncoupled from its abutment.

BRIEF DESCRIPTION OF THE DRAWINGS

Moreover, with regard to preferred features of this invention, reference is made to the claims as well as the following explanation of the drawing on the basis of which an especially preferred embodiment is described in greater detail.

The figures show.

Figure 1:
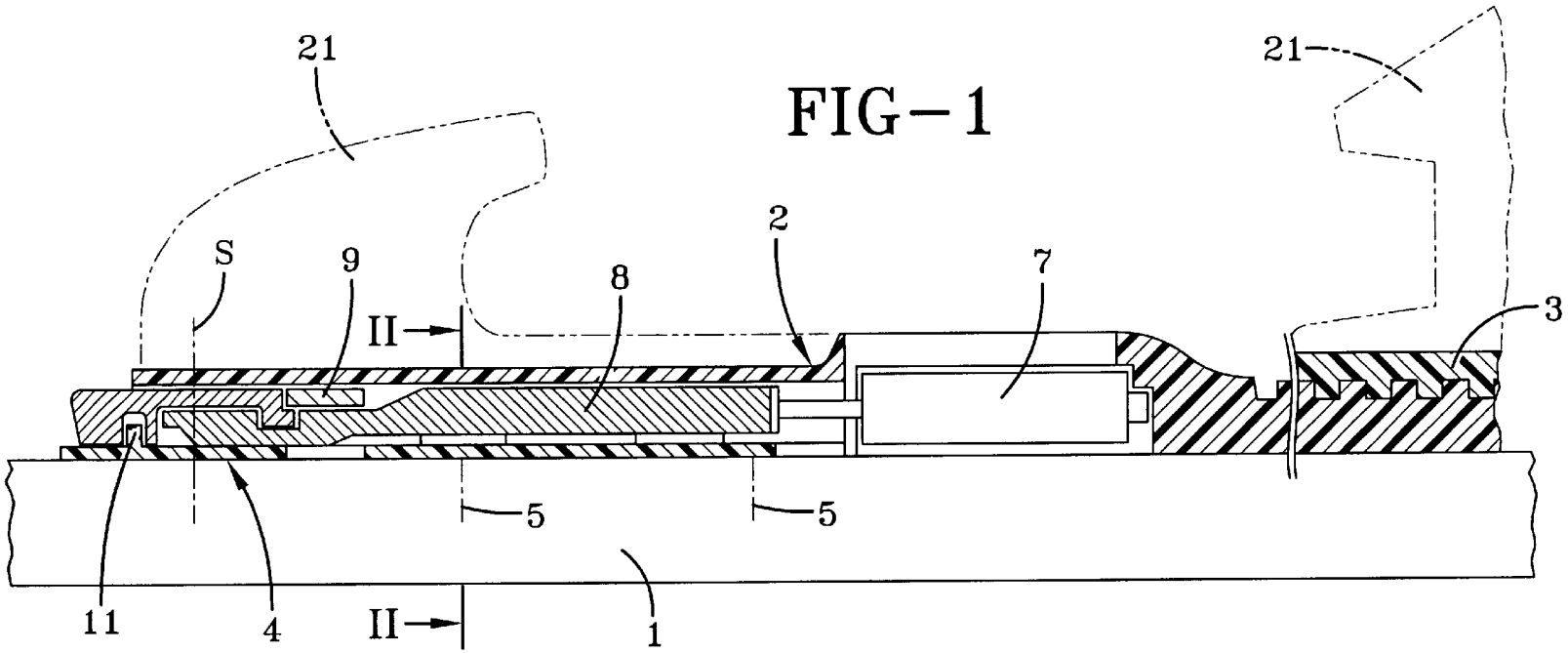
FIG. 1: a longitudinal section through the device according to this invention.

According to FIG. 1, a first essentially board-shaped abutment part 2 is arranged on the top side of a ski 1, a detail of which is shown here. The abutment part 2 is secured on the ski 1 by means of a retaining part 3, which is also essentially board-shaped and engages around the right end of the abutment part 2 as seen in FIG. 1 and with its own gear teeth it engages mating gear teeth on the abutment part 2 in a form-fitting manner. The retaining part 3 is secured on the ski 1 with screws (not shown here).

Figure 2:
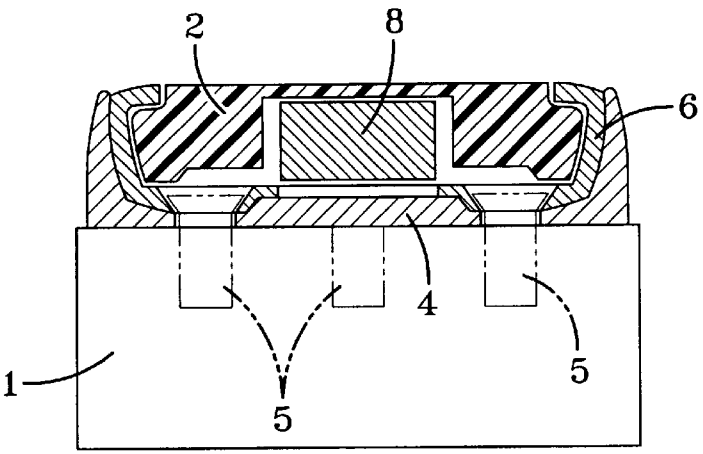
FIG. 2: a cross section according to sectional place II—II in FIG. 1.

On the other end of the abutment part 2, there is another abutment part 4 which is also attached to the ski 1 with screws 5 at a distance from the retaining part 3 in the longitudinal direction of the ski. A sliding guide 6 made of metal is embedded in the abutment part 4, which is made of plastic, like the abutment part 2 and the retaining part 3 (see FIG. 2). With rails or sliding guides having a C-shaped cross-section facing one another with their concave sides, this sliding guide 6 fits around suitably shaped longitudinal edges of the abutment part 2 which are displaced in the longitudinal direction of the ski relative to the sliding guide 6 and to the abutment part 4 in the case of flexing movements of the ski. This is due to the fact that the abutment part 4 is arranged at a vertical distance from the neutral bending zone of the ski and is retained by means of the retaining part 3 at a greater distance from the sliding guide 6 in the longitudinal direction of the ski.

Figure 3:
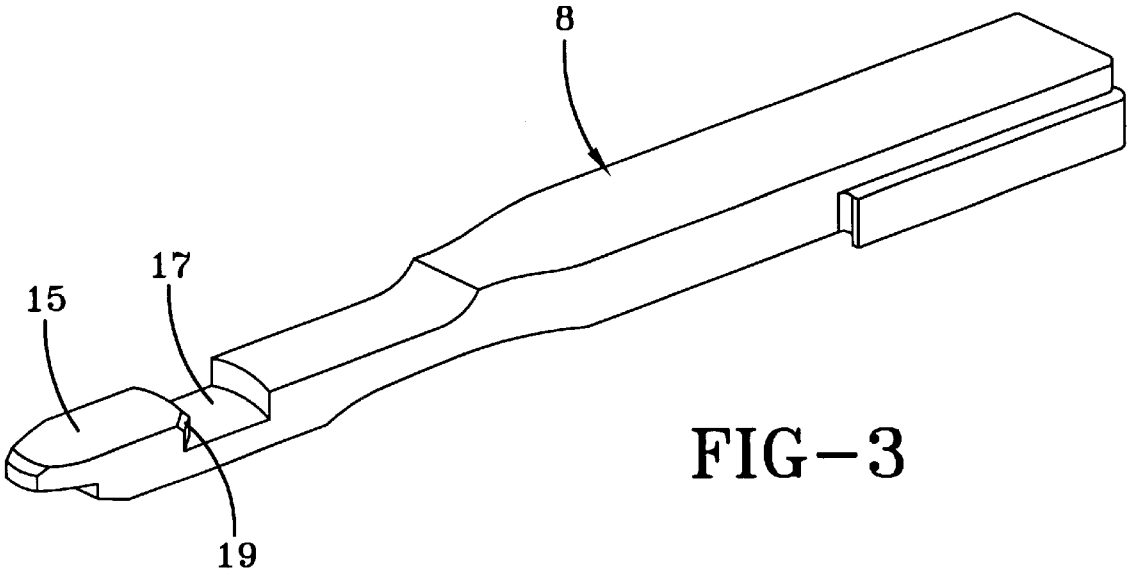
FIG. 3: a perspective view of the coupling part as seen obliquely from above.

The cylinder of a hydraulic damper 7, which is designed as a piston-cylinder unit, is arranged inside a corresponding recess in the abutment part 2 which extends in the longitudinal direction of the ski with a clamping or locking effect. The piston rod of the damper 7 is connected to a coupling part 8 (see also FIG. 3) which extends in a corresponding longitudinal channel on the lower side of the abutment part 2 and passes through it and beneath a guide plate 9 which is integrally molded on the abutment part 4 (see FIG. 1).

The coupling part 8 works together with a mating coupling part 10 which is designed as a rotary slide, in a manner to be explained in greater detail below, and is mounted to pivot about a vertical pivot axis S (see FIG. 1) on the abutment part 4.

Figure 4:
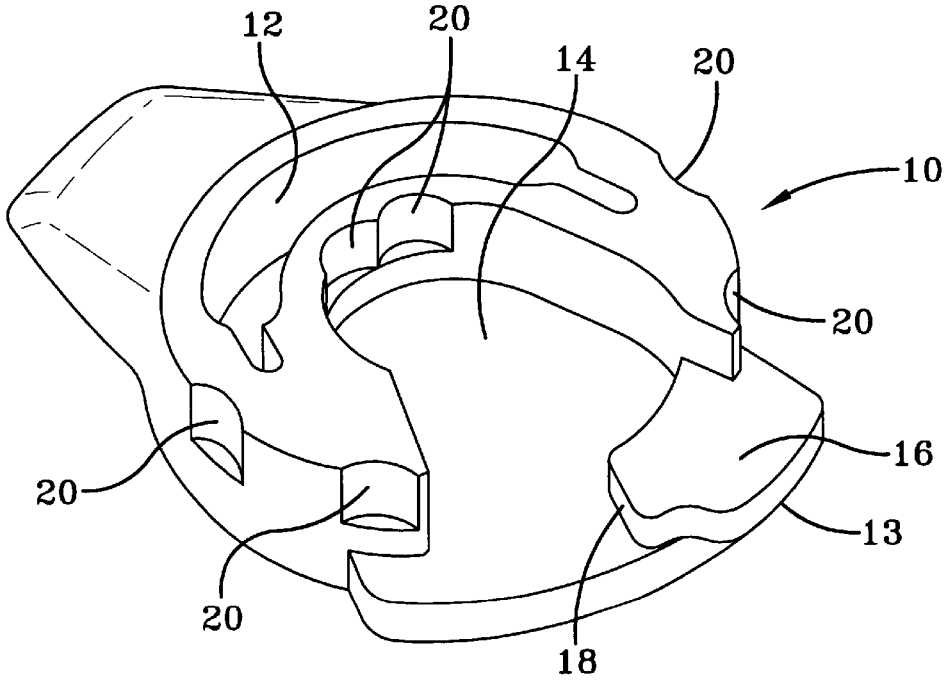
FIG. 4: a perspective view of the mating coupling part as seen obliquely from beneath.

The elements for the rotational mounting of the mating coupling part 10 are arranged at a distance from the pivot axis S and extend around an essentially arch-shaped web 11 which is visible in FIG. 1 and is integrally molded on the abutment part 4 and engages in a groove 12, which can be seen well in FIG. 4 on the lower side of the mating coupling part 10 with some play in the direction of the arch; in other words, the groove 12 forms a guide crank for the web 11 in such a way that the mating coupling part 10 can be adjusted rotationally between two end positions. A handle (not numbered), the part which looks like a nose, is used to adjust the mating coupling part 10 between its two positions. In addition, the mating coupling part 10 reaches beneath the guide plate 9 of the abutment part 4 with an edge 13 that projects outward radially.

In the area of the pivot axis S, a recess 14 opening outward radically in some areas is formed on the lower side of the mating coupling part 10 and a claw-shaped end 15 of the coupling part 8 which is remote from the damper can be inserted into this recess in an appropriate rotational position of the mating coupling part 10. Through an appropriate rotational adjustment of the mating coupling part 10, a locking bar piece 16, which is integrally molded on it, can be inserted into a lock recess 17 next to the claw-shaped end 15 of the coupling part 8. In this position, which is illustrated in FIG. 1, the coupling part 8 and the mating coupling part 10 are coupled together, i.e., the claw-shaped end 15 of the coupling part 8 is secured in the longitudinal direction of the ski within the recess 14 in the mating coupling part 10, with the result that the piston rod of the damper 7 is displaced relative to the cylinder of the damper 7 when there is a flexing movement of the ski 1, and the damper 7 produces a damping resistance that counteracts the flexing movements accordingly.

However, when the mating coupling part 10 is rotated into its other end position, the locking bar piece 16 of the mating coupling part 10 comes completely out of the lock recess 17 of the coupling part 8, so that the claw-shaped end 15 of the coupling part 8 is released and the coupling part 8 and the mating coupling part 10 are uncoupled from one another. When there are flexing movements of the ski 1, mainly the coupling part 8 is displaced into the cylinder of the damper in the case of the first flexing movement, pushing the piston rod into the cylinder of the damper 7. Then the coupling part 8 is held more or less securely in the displaced position due to the resistance of the damper 7, with the result that the damper 7 does not execute any lifting movements in the case of flexing movements and thus it remains ineffective accordingly.

In order to make it possible again to lock the claw-shaped end 15 of the coupling part 8 in the mating coupling part 10, even when the claw-shaped end 15 assumes a position outside the recess in the mating coupling part 10, a ramp 18 is formed on the locking bar piece 16 and works together with a mating ramp 19 on the claw-shaped end 15 of coupling part 8, pushing the claw-shaped end 15 of the coupling part 8 into the recess 14 with a corresponding rotation of the mating coupling part.

Instead of or in addition to that, it is also possible to provide for the piston rod of the damper 7 to be under a slight prestress in the direction of extraction, so that it tends to creep out of an inserted position in the cylinder of the damper 7. This makes it possible to guarantee that the claw-shaped end 15 again assumes a position in the recess 14 of the mating coupling part 10 after a certain delay time, and accordingly a rotational adjustment of the mating coupling part 10 is possible with the insertion of the locking bar piece 16 into the lock bar recess 17.

The end rotational positions of the mating coupling part 10 are designed as catch layers in which catch elements (not shown) which are integrally molded on the abutment part 4 work together with catch recesses 20 on mating coupling part 10.

The top side of the end area of the abutment part 4, shown at the left in FIG. 1, as well as the top side of the retaining part 3 serve to receive shoe holder elements 21 of a ski binding on the toe end and the heel end, respectively. These shoe holder elements 21 are indicated with dotted lines in FIG. 1. The device according to this invention for damping flexing movements of a ski or the like also assumes the function of a standing plate or a spacer plate for the ski binding.

Figure 5:
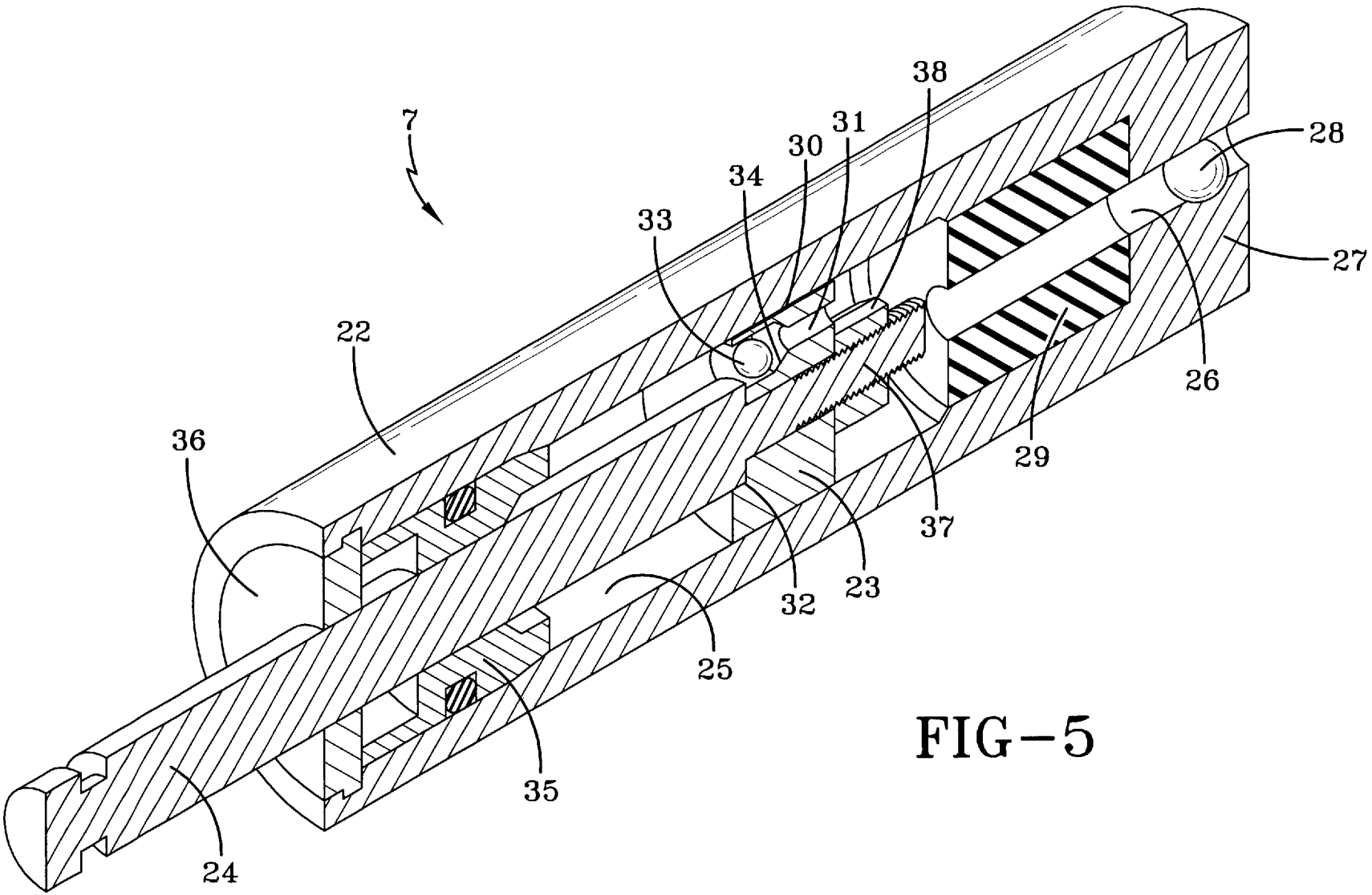
FIG. 5: a perspective sectional diagram of a damper according to this invention.

FIG. 5 shows an especially preferred embodiment of the damper 7, which is designed as a piston-cylinder unit with a cylinder 22 and a piston 23 which is displaceable in it and has a piston rod 24 arranged at one end. The cylinder 22 has a cylinder bore 25 which has multiple steps and terminates at the right end of the cylinder 22 in FIG. 5 in a filling bore 26 having the same axis as the cylinder bore 25; it is arranged in a bottom 27 molded in one piece on the cylinder 22 and sealed by a ball 28 which is pressed into the filling bore 26. Within the section of the cylinder bore 25 adjacent to the bottom 27 and having a slightly smaller diameter than the central section of the cylinder bore 25 which is provided for the piston 23, a compressible foam body 29 is held by a press fit with a gas-filled cellular structure having closed pores and an axial bore which passes completely through the foam body 29 and continues coaxially with the filling bore 26. The foam body 29 may be made of a cellular rubber or a silicone foam, for example, with a density of approximately 0.5 g/cm$^3$.

Between the outer circumference of the piston 23 and the inner circumference of the central section of the cylinder bore 25 receiving the piston 23, there is at least one throttle gap 30 through which the cylinder bore parts in front of and behind the piston 23 communicate with one another. In addition, an axial stepped bore 31 is arranged in the piston 23, whose larger section with regard to the diameter is arranged on the piston rod end in such a way that the opening cross section is partially covered by an annular step 32 on the piston rod 24. Within the section of the stepped bore 31 having the larger diameter, there is a closing body 33 which has a spherical shape in the example shown here and works together with the conical annular step 34 of the stepped bore 31 in the manner of a valve seat; in other words, together with the annular step 34, the closing body 33, whose diameter is smaller than the diameter of the part of the stepped bore 31 receiving the closing body 33, forms a nonreturn valve which opens when there is a pressure gradient in the direction of the piston rod 24 and closes when the pressure gradient is in the opposite direction.

A guide bushing or seal packing 35 made of Delrin 100, for example, for the piston rod is arranged on the left end of the cylinder 22 on the piston rod end in FIG. 5. This bushing 35 is retained axially between an inner cone on the cylinder 22 and a disk-shaped bottom 36, which is held by an end edge of the cylinder 22 which is flanged or pressed with the bottom 36. The guide bushing 35 is sealed with respect to the cylinder 22 by an O-ring on the outside and by a lip seal with respect to the piston rod 24 on the inside.

In the example shown here, piston 23 and piston rod 24 are connected to one another so that the piston 23 with a central axial bore is pushed onto a threaded projection 37 of the piston rod 24 and is held under tension against the annular step 32 of the piston rod 24 by means of a nut 38 which is screwed onto the threaded projection 37.

The damper 7 is completely prefabricated in production, but without inserting the ball 28 into the filling bore 26. Before the subsequent filling, the piston rod is pulled out toward the left in FIG. 5, so that the piston 23 reaches its end position on the seal packing 35. Then the cylinder 22 is filled with a hydraulic medium through the filling bore 26. This filling may optionally take place under an excess pressure. Then the filling bore 26 is sealed by means of the ball 28.

When the piston rod is moved to the right in FIG. 5, the foam body 29 is first compressed elastically because the piston rod 24 entering into the cylinder 22 displaces the hydraulic medium. The foam body 29 thus forms a "volume buffer" by means of which the hydraulic medium is kept in the cylinder 22 without bubbles and is optionally also kept under a constant excess pressure, regardless of the temperature of the hydraulic medium. Due to the compressed foam body 29, a hydraulic restoring force is exerted on the piston rod 24, attempting to push the piston rod 24 with the piston 23 toward the left in FIG. 5, into or almost into the left end position.

In a pressure stroke of piston 23 and piston rod 24 (which is the direction of movement toward the right in FIG. 5), the nonreturn valve formed by the closing body 33 and the annular step 34 in the stepped bore 31 assumes its open position so that only a low hydrodynamic resistance acts against the pressure stroke. In the tension stroke, however, the nonreturn valve formed by the closing body 33 and the annular step 32 closes, so that the cylinder chambers which are divided from one another by the piston 23 in the cylinder 22 communicate with one another only through the throttle gap 30 between the outer circumference of the piston 23 and the inner circumference of the cylinder 22, and a large hydrodynamic resistance occurs accordingly in the tension stroke.

Thus, as a result, the pressure stroke is damped weakly and the tension stroke is damped to a great extent.

If the damper 7 is arranged as shown in FIG. 1, and the coupling part 8 and the mating coupling part 10 are coupled to one another, then the piston 23 and piston rod 24 execute weakly damped pressure strokes relative to the cylinder 22 in the case of flexing movements of the ski, when the ends of the ski move upward relative to the area of the bindings. However, in the case of counter-flexing movements of the ski when the ends of the ski move downward relative to the area of the bindings of the ski, the tension strokes are damped to a great extent.

If the damper 7 is filled with hydraulic medium under excess pressure, the foam body 29 is more or less compressed in all positions of the piston 23 as well as the piston rod 24, i.e., the hydraulic medium remains under a constant excess pressure. Accordingly, the guide bushing or seal packing 35 is constantly under an excess pressure. This is advantageous because the sealing elements are thus constantly pressed hydraulically against adjacent surfaces of the piston rod 24 and the cylinder 22 and thus remain effective in sealing.

The invention has been described with particular emphasis on the preferred embodiments, but variations and modifications within the spirit and scope of the invention may occur to those skilled in the art to which the invention pertains.

What is claimed is:

1. A device for damping the flexing movements of a ski or a snowboard, with a damper unit having two damper elements displaceable relative to one another in a longitudinal direction of the ski against a damping resistance and are arranged on the top side of the ski, comprising:

a first abutment mountable fixedly on the top of the ski, one of said damper elements being retained by said abutment, a second abutment mountable on the top of the ski at a distance in the longitudinal direction from the first abutment, the other of said damper elements being detachably connected to said second abutment, and a coupling part and a mating coupling part, wherein:

the other damper element is fixedly connected to the coupling part mateable with the mating coupling part pivotally mounted on the second abutment, said mating coupling part being adjustable between two end positions, said coupling part being held in a form-fitting manner in the longitudinal direction relative to the second abutment in the one end position of the mating coupling part and being movable in the longitudinal direction in the other end position of the mating coupling part.

2. The device according to claim 1, wherein:

the mating coupling part is a slide, said coupling part has a claw, and said one end position engages said claw in a form-fitting manner and said other end position releases said claw.

3. The device according to claim 2, wherein:

said slide is a rotary slide and said mating coupling part further comprises a peripheral wall having a recess and a bar piece, said bar piece engages said claw in the longitudinal direction when said mating coupling part is in the one end position and said recess releases said claw when said mating coupling part is in the other end position.

4. The device according to claim 1, wherein:

the distance in the longitudinal direction from the first abutment is larger than the longitudinal extent of the damper unit.

5. The device according to claim 1, wherein:

the coupling part is guided along at least one of the first abutment and the second abutment in the manner of a slide.

6. The device according to claim 1, wherein:

the first abutment is connected to a retaining part fixedly mounted on the ski and adjustable in the longitudinal direction.

7. The device according to claim 1, wherein:

the damper unit is under a weak tension and attempts to creep into its one condition in which the coupling part and the mating coupling part are coupled together.

8. The device according to claim 1, wherein:

the damper unit is designed as a piston-cylinder unit having the cylinder in a recess in the first abutment in a form-fitting manner.

9. The device according to claim 1, wherein:

the one end position and the other end position of the mating coupling can be locked.

10. The device according to claim 1, wherein:

the damper unit is a hydraulic damper.

11. The device according to claim 1, wherein:

the damper unit is designed as a piston-cylinder unit having the cylinder in a recess in the first abutment in a frictionally connected manner.

12. The device according to claim 10, wherein:

said hydraulic damper is at least one of a gelatinous or pastry hydraulic medium.

13. A device for damping the flexing movements of a ski or a snowboard, with a damper unit having two damper elements displaceable relative to one another in a longitudinal direction of the ski against a damping resistance and are arranged on the top side of the ski, comprising:

a first abutment mountable fixedly on the top of the ski, one of said damper elements being retained by said first abutment, and a second abutment mountable on the top of the ski at a distance in the longitudinal direction from the first abutment, the other of said damper elements being detachably connected to said second abutment, wherein:

the first abutment is connected to a retaining part fixedly mounted on the ski and adjustable in the longitudinal direction, and the retaining part and the first abutment together form a base for receiving a ski binding having heel and toe ends and further having shoe holding elements on the heel and toe ends.

14. A device for damping flexing movements of a ski or a snowboard, having a damper unit which has two damper elements that are displaceable relative to one another in a longitudinal direction against a damping resistance, and are arranged on the top side of the ski or the snowboard, the one element being secured on a first abutment which can be fixedly mounted on the ski or the snowboard, and the other element being detachably coupled to a second abutment or being constantly secured on the second abutment which can be mounted on the ski or the like at a distance from the first abutment in the longitudinal direction, wherein:

the damper unit dampens to a great extent counter-flexing movements of the ski or the snowboard, the piston comprises at least one nonreturn valve opening in the direction of the piston rod, and at least one nonreturn valve has a stepped bore, which passes axially through the piston and a valve body arranged in the part of the stepped bore which has a wider diameter and which is held like a cage on the piston rod between the annular step, which acts like a valve seat, and an edge which is arranged at the outlet opening of the nonreturn valve and covers a portion of the outlet opening.

15. The device according to claim 14, wherein:

the damper unit is a piston-cylinder unit having a piston and a cylinder, and said damper unit has a piston rod arranged on one end of the piston and a foam body compressible in the cylinder, said damper unit being compressed in the compression stroke of the piston rod and undergoing elastic expansion in the tension stroke of the piston rod.

16. The device according to claim 14, wherein:

a throttle gap is arranged between the outer circumference of the piston and the inner circumference of the cylinder.

17. The device according to claim 14, wherein:

a filling opening is arranged in the cylinder bottom coaxially with an axial channel in the foam body which is adjacent to the bottom on the side of the cylinder which faces away from the piston rod.

* * * * *